United States Patent [19]

Berman

[11] 4,303,187

[45] Dec. 1, 1981

[54] MULTIPLE POCKET CLOTHING ACCESSORY

[76] Inventor: Charles Berman, 6025 Shore Blvd. South #614, Gulfport, Fla. 33707

[21] Appl. No.: 164,833

[22] Filed: Jun. 30, 1980

[51] Int. Cl.[3] ..... A45C 11/00

[52] U.S. Cl. ..... 224/222; 224/226; 224/240

[58] Field of Search ..... 224/222, 223, 224, 226, 224/227, 228, 236, 240

[56] References Cited

U.S. PATENT DOCUMENTS

| | | | |
|---|---|---|---|
| 315,303 | 4/1885 | Lambert | 224/240 |
| 668,466 | 2/1901 | Taylor et al. | 224/226 |
| 1,416,238 | 5/1922 | Seiler | 224/226 X |
| 3,322,311 | 5/1967 | Homer | 224/222 |
| 3,363,813 | 1/1968 | Eastman | 224/222 X |
| 3,949,916 | 4/1976 | Yount | 224/240 |
| 4,103,807 | 8/1978 | Lyon et al. | 224/222 |

*Primary Examiner*—Steven M. Pollard

*Attorney, Agent, or Firm*—Philip D. Amins

[57] ABSTRACT

A multiple pocket clothing accessory is provided which includes a base panel, the upper portion of which has a pair of belt loops through which a wearer passes their belt thereby securing the device to his trousers. The lower portion of the base panel includes a tie string which the wearer ties around his thigh. A plurality of pockets including closed and open pockets are disposed on an intermediate portion of the base panel thereby providing both secure and convenient storage for personal objects.

14 Claims, 5 Drawing Figures

MULTIPLE POCKET CLOTHING ACCESSORY

BACKGROUND OF THE INVENTION

Recent trends in clothing fashions for both adults and children have led to a widespread and increasingly high rate of usage of trousers of the jeans type. These trousers are cut so as to generally conform closely to the contours of the body and usually include several pockets of the patch type. This type of pocket is constructed of a single panel of fabric which has three adjacent marginal edges sewn to the body of the garment leaving the fourth edge open for insertion of objects into the pocket. The narrow body conforming cut of jeans-type trousers makes such pockets awkward to use because it is relatively difficult to place a hand into the pocket in order to insert or remove objects. Even when slash-type pockets are provided, which have an interior fabric envelope, which is accessible through a slash in the fabric of the garment, the narrow cut of the jeans-type of trouser renders these pockets impractical or awkward, because objects inserted in such pockets cause objectionable bulges which detract from the trim line of the garment and are, therefore, considered objectionable. In addition, because of the relatively close fit of the jeans-type of trouser, when an object is inserted into a pocket, either of the slash-type or the patch-type, and the wearer engages in an active sport such as bicycling or an activity such as dancing, the object tends to work its way out of the pocket thereby becoming lost.

The problems described result in an anomalous situation in which the pockets provided on the jeans-type of trousers, even though they represent a significant portion of the manufacturing cost of this garment, do not contribute to the utility of the garment and are often considered to be non-functional by the wearer.

OBJECTS OF THE INVENTION

It is the primary object of the present invention to provide a multiple pocket clothing accessory for use with trousers of the jeans type which provides the wearer with a plurality of comfortable and secure pockets.

Another object of the present invention is to provide a multiple pocket clothing accessory which can be secured to a trouser belt.

Another object of the present invention is to provide a multiple pocket clothing accessory which can be secured to the thigh of a wearer.

Another object of the present invention is to provide a multiple pocket clothing accessory which has an adjustable fastener enabling the device to be secured to the thighs of different sized wearers.

Another object of the present invention is to provide a multiple pocket clothing accessory which may be fabricated in a wide variety of fabric materials thereby providing a contrast or a match with the fabric of the garment on which the accessory is worn.

Another object of the present invention is to provide a multiple pocket clothing accessory which may be used both by male and female wearers.

A further object of the present invention is to provide a multiple pocket clothing accessory which comprises a relatively small number of component parts which are relatively economical of manufacture.

SUMMARY OF THE INVENTION

In accordance with one embodiment of the present invention, a multiple pocket clothing accessory is provided which is constructed of fabric or similar material, and which includes a base panel, on the upper portion of which there is disposed an adjustable belt loop portion through which a wearer passes a belt thereby attaching the device to their trousers. A plurality of pockets are disposed on the base panel and are attached to the base panel by sewing, bonding or other known garment construction techniques. The lower portion of the base panel includes a tie string which the wearer ties around their thigh thereby further securing the device. The plurality of pockets includes pockets which enclose interior pockets and pockets which are disposed one upon another forming a multiple pocket.

In an alternative embodiment of the invention, the tie string is replaced by a pair of flexible straps having a plurality of snap fasteners. The plurality of snap fasteners enables different sized wearers to fasten the straps around their thighs.

BRIEF DESCRIPTION OF THE DRAWINGS

The foregoing and other objects, features and advantages of the present invention will become readily apparent to those skilled in the art from the detailed description hereinafter, considered in conjunction with the accompanying drawings, wherein.

DETAILED DESCRIPTION OF THE PREFERRED EMBODIMENT

Figure 1:
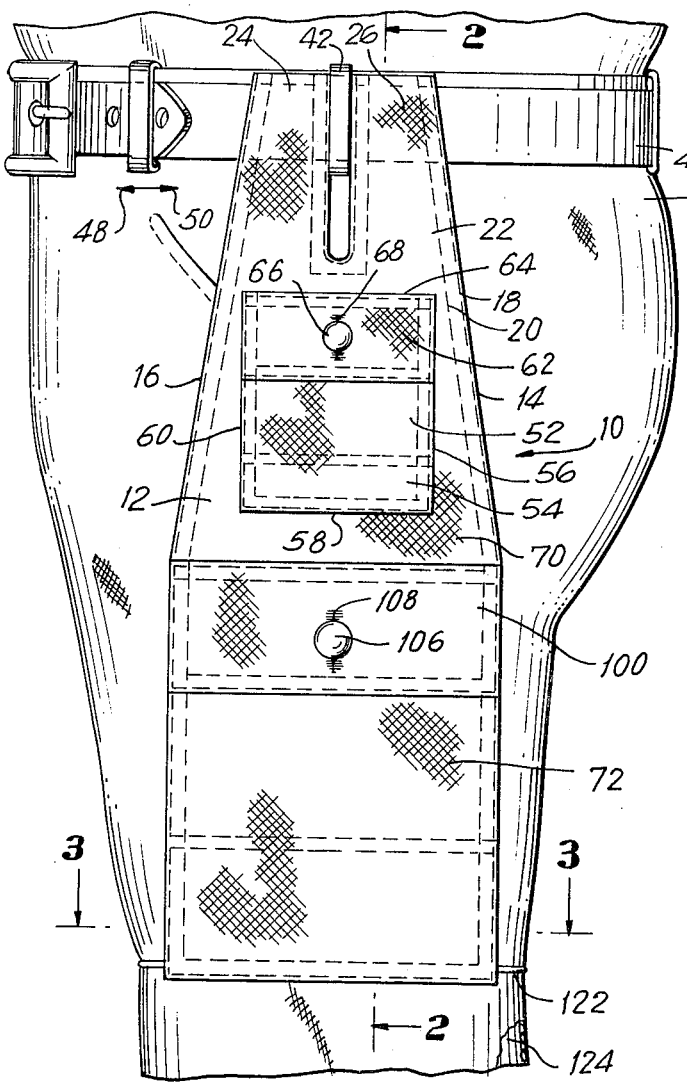
FIG. 1 is a front elevation view of a multiple pocket clothing accessory made in accordance with the present invention with the device shown in use by a wearer.
Figure 2:
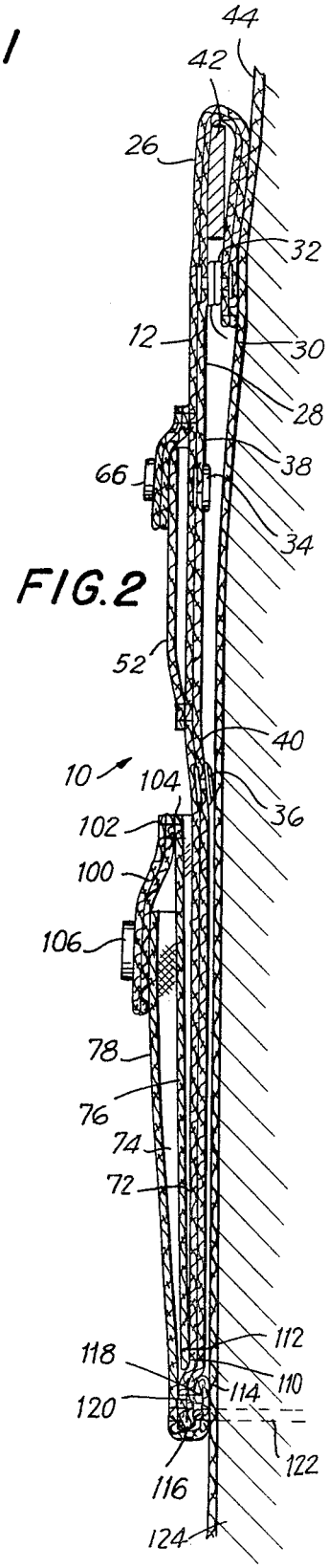
FIG. 2 is a longitudinal sectional view taken along the line 2—2 of FIG. 1.
Figure 3:
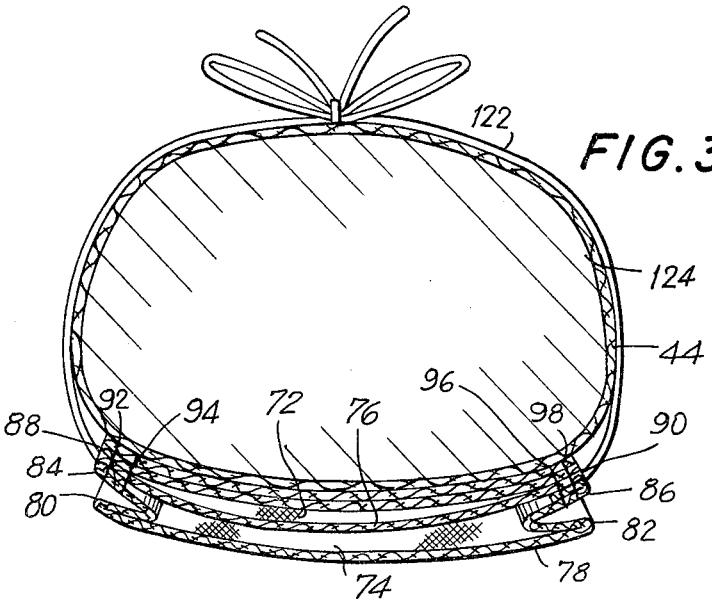
FIG. 3 is a transverse sectional view taken along the line 3—3 of FIG. 1.

Referring now to the drawings, and in particular to FIGS. 1, 2 and 3, there is shown one embodiment of the present invention which comprises a multiple pocket clothing accessory generally denoted by the reference numeral 10. The multiple pocket clothing accessory 10 is best shown in FIG. 1 and comprises a base panel 12 which is formed of a double layer of fabric or similar material and which is sewn along marginal edges 14, 16 as indicated by the broken lines 18, 20 in FIG. 1. The upper portion 22 of the base panel 12 includes a pair of spaced apart belt loops 24, 26 which are formed by folding the upper portion 22 of the base panel 12 as is shown in FIG. 2. The inner surface 28 of the base panel 12 includes a pair of male and female snap fasteners which are used to close the belt loops 24, 26, with a female fastener of the pair designated by the reference numeral 30 and with a male fastener of the pair designated by the reference numeral 32. Additional female fasteners such as the female fasteners 34, 36 are disposed on intermediate locations 38, 40 of the base panel 12. The male fastener 32 may be connected to the female fasteners 30, 34 or 36, as desired, thereby effectively lengthening or shortening the belt loops 24, 26 as desired, for different wearing configurations.

As is shown in FIG. 1, the belt loops 24, 26 are spaced apart and fit on either side of the belt loop 42 of the wearer's trousers 44 thereby preventing the device 10 from sliding along the belt 46 in the directions of the arrows 48, 50. The belt 46 passes through the belt loops 24, 26 as is shown in FIG. 2 and supports the weight of the device 10.

The upper portion 22 of the base panel 12 includes a pocket 52 which is formed by sewing a rectangular panel 54 of fabric to the base panel 12 along three marginal edges 56, 58, 60. A closure flap 62 is provided which has an upper edge 64 sewn to the base panel 12 and which is held closed by a button 66 attached to the panel 54 and which passes through the buttonhole 68 in the closure flap 62.

The lower portion 70 of the base panel 12 includes a pair of pockets 72, 74. The first pocket 72 is formed by a first rectangular fabric panel 76. The second pocket 74 is formed by a second fabric panel 78 which has a pair of longitudinal edge portions each of which is folded first inward and then outward forming a pair of convolutions 80, 82, as is best shown in FIG. 3. The outer edges 84, 86 of the second fabric panel 78 are in general alignment with the edges 88, 90, respectively, of the first rectangular panel 76 and are sewn together with the edges of the first rectangular panel 76 to the base panel 12 as indicated by the stitches 92, 94, 96, 98 in FIG. 3. The convolutions 80, 82 enable the pocket 74 to expand and accommodate bulky objects with relative ease. A rectangular closure flap 100 is provided which has an upper edge 102 sewn to the upper edge 104 of the panel 76. The closure flap 100 is held closed by a button 106 attached to the second fabric panel 78 and which passes through the buttonhole 108 in the closure flap 100.

The lower edge 110 of the first rectangular panel 76 is sewn to the base panel 12 as is indicated by the stitches 112 in FIG. 2. The lower edge 114 of the second panel 78 is folded around the lower edge 110 of the first rectangular panel 76 and around the lower edge of the base panel 12 and then is sewn to the base panel 12 as indicated by the stitches 118 leaving an open loop 120 which extends across the width of the base panel 12. A tie string 122 passes through the loop 120 and, in use, the wearer ties the string 120 around his thigh 124 as is shown in FIGS. 1, 2 and 3. The combination of the spaced belt loops 24, 26 and the tie string 122 holds the multiple pocket clothing accessory 10 securely in a fixed and relatively comfortable position, enabling the wearer to engage in whatever activities are desired while the closure flaps 62, 100 maintain the security of objects placed in the pockets 52, 74.

DESCRIPTION OF ALTERNATIVE EMBODIMENTS

Figure 4:
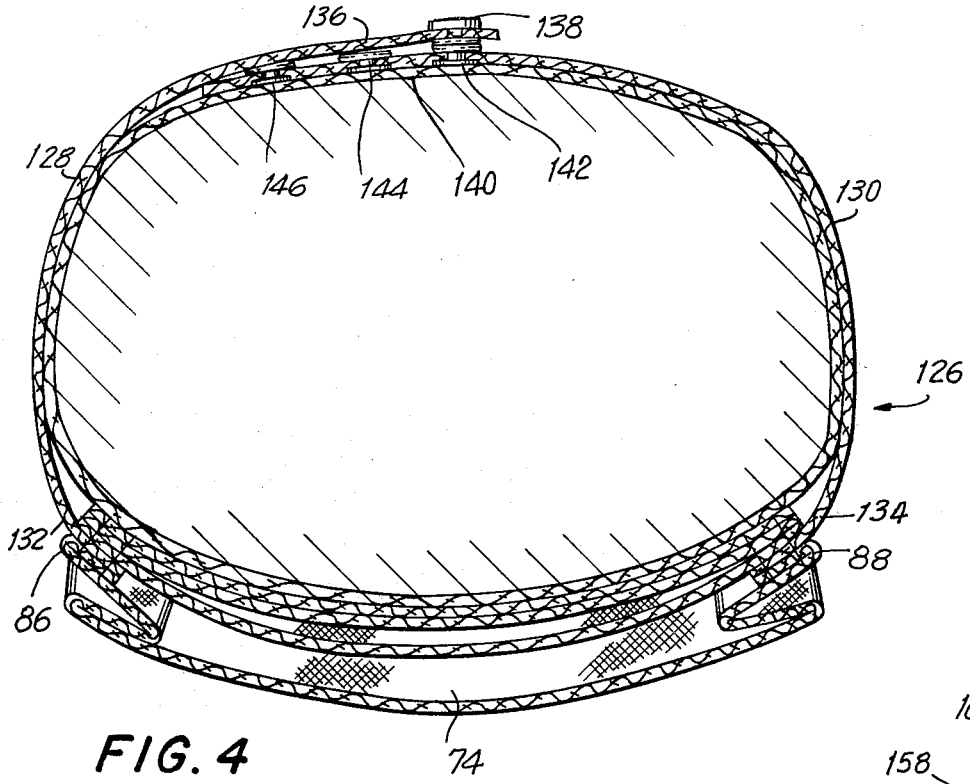
FIG. 4 is a transverse sectional view similar to FIG. 3 showing an alternative embodiment of the invention incorporating a flexible leg band having snap fasteners.

In a first alternative embodiment of the invention 126, which is shown in FIG. 4, the tie string 122 is replaced by a pair of flexible bands 128, 130. The first flexible band 128 has a first end 132 which is sewn together with the left marginal edge 86 of the pocket 74 and the second flexible band 130 has a first end 134 which is sewn together with the right marginal edge 88 of the pocket 74. The second end 136 of the first flexible band 128 has a male snap fastener 138 and the second end 140 of the second flexible band 130 has a plurality of spaced female snap fasteners 142, 144, 146. The plurality of female snap fasteners permits the flexible bands 128, 130 to be used comfortably by different wearers having different thigh sizes.

Alternatively, interlocking fastener members such as Velcro fasteners may be used instead of the plurality of snap fasteners described.

Figure 5:
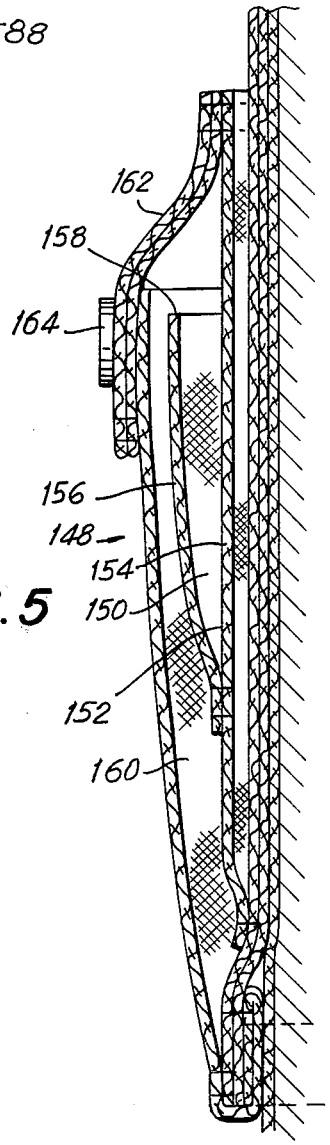
FIG. 5 is a fragmentary longitudinal sectional view similar to FIG. 2 incorporating a pocket which is mounted on a second pocket, with the first pocket having an internal pocket.

In a second alternative embodiment of the invention 148, which is shown in FIG. 5, an interior pocket 150 is disposed on the surface 152 of the fabric panel 154. The interior pocket 150 is formed by a fabric panel 156 which is stitched to the panel 154 along its left, right and lower marginal edges leaving the top edge 158 open. The interior pocket 150 is completely enclosed within the pocket 160 and the flap 162 and the button 164 maintain the security of objects placed in the interior pocket 150 as well as in the pocket 160.

The multiple pocket clothing accessory has been described as being made of fabric. The fabric material utilized may be a cotton denim in order to coordinate with the fabric materials most commonly used in the manufacture of the jeans type of trousers. However, other fabric materials either woven or non-woven in construction may be utilized as well as flexible plastic film materials such as vinyl. The device 10 may be provided in a broad range of colors in order to either match or to coordinate with the color of the trousers.

The method of construction of the multiple pocket clothing accessory 10 has been described as sewing or stitching; however, any one of a number of known methods of garment construction such as bonding or riveting may be utilized.

In addition, female wearers desiring to use the primary embodiment of the multiple pocket clothing accessory 10 with a belted skirt instead of with trousers can accomplish this by simply pulling the tie string out of the loop and storing it in one of the pockets for later use.

While I have shown and described three embodiments of the present invention, it will be appreciated that the teachings here will readily lend themselves to many modifications, changes, combinations and improvements by those skilled in the art without deviating from the present invention or the teachings hereof.

What is claimed is:

1. A multiple pocket clothing accessory comprising
a base panel including
an upper portion,
a lower portion, and
an intermediate portion,
said upper portion being bifurcated to form a pair of spaced apart belt loop portions,
said belt loop portions being disposed on said upper portion of said base panel for the purpose of securing said upper portion to the belt of a user,
said belt loop portions being spaced from one another a distance substantially equal to the width of a belt loop of a pair of trousers worn by said user so as to enable said belt loop portions to be disposed in juxtaposition with respect to said belt loop,
leg band means disposed on said lower portion of said base panel for the purpose of securing said lower portion to the thigh of a user, and
pocket means disposed on said intermediate portion of said base panel.

2. A multiple pocket clothing accessory in accordance with claim 1, wherein said belt loop portions are formed by folding said bifurcated upper portion of said base panel, and comprising fastener means connecting an upper edge of said base panel to an intermediate portion of said base panel.

3. A multiple pocket clothing accessory in accordance with claim 2, including a plurality of fastener means disposed on said base panel for enabling said upper edge of said base panel to be joined to a selectable intermediate portion of said base panel.

4. A multiple pocket clothing accessory in accordance with claim 3, wherein said plurality of fastener means comprises snap fasteners.

5. A multiple pocket clothing accessory in accordance with claim 1, wherein said leg band means comprises a tie string attached to said lower portion of said base panel.

6. A multiple pocket clothing accessory in accordance with claim 1, wherein said leg band means comprises a loop formed in said lower portion of said base panel, and a tie string which passes through said loop.

7. A multiple pocket clothing accessory in accordance with claim 1, wherein said leg band means comprises a pair of flexible straps each having an end connected to said lower portion of said base panel and a free end, and fastener means disposed on said free ends of said straps.

8. A multiple pocket clothing accessory in accordance with claim 1, wherein said pocket means includes at least one pocket comprising an auxiliary panel secured to said base panel along all but one marginal edge, and a flap disposed to removably close said one marginal edge.

9. A multiple pocket clothing accessory in accordance with claim 1, wherein said pocket means includes a first pocket disposed on said base panel, and a second pocket disposed on said first pocket.

10. A multiple pocket clothing accessory in accordance with claim 9, further comprising a third pocket disposed on said first pocket and enclosed within said second pocket.

11. A multiple pocket clothing accessory in accordance with claim 1, wherein said accessory is formed of a fabric material.

12. A multiple pocket clothing accessory in accordance with claim 1, wherein said accessory is formed of a flexible plastic film.

13. A multiple pocket clothing accessory in accordance with claim 1, wherein said pocket means are attached to said base panel by stitches.

14. A multiple pocket clothing accessory in accordance with claim 1, wherein said pocket means are attached to said base panel by bonding.

* * * * *